US006543636B1

(12) United States Patent
Flecheux et al.

(10) Patent No.: US 6,543,636 B1
(45) **Date of Patent: *Apr. 8, 2003**

(54) METHOD FOR MAKING AN AEROSOL HOUSING WITH THREADED NECK

(75) Inventors: Franck Flecheux, Bellegarde sur Valserine (FR); Jacques Granger, Libourne (FR); Bernard Schneider, Sainte Menehould (FR)

(73) Assignee: Cebal, S.A., Clichy (FR)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/402,459

(22) PCT Filed: Feb. 23, 1999

(86) PCT No.: PCT/FR99/00399

§ 371 (c)(1),
(2), (4) Date: Oct. 8, 1999

(87) PCT Pub. No.: WO99/43558

PCT Pub. Date: Sep. 2, 1999

(30) Foreign Application Priority Data

Feb. 26, 1998 (FR) ..... 98 02571

(51) Int. Cl.[7] ..... B65D 41/04; B23P 11/02

(52) U.S. Cl. ..... 220/288; 215/44; 215/329; 29/450; 29/523

(58) Field of Search ..... 29/523, 450, 451, 29/522.1; 215/12.1, 44, 329; 220/288, 634

(56) References Cited

U.S. PATENT DOCUMENTS 2,165,622 A * 7/1939 Donahue
2,485,960 A * 10/1949 Donahue
2,829,802 A * 4/1958 Paull
3,196,819 A 7/1965 Lechner et al.
3,938,240 A * 2/1976 Holden ..... 29/523
3,977,068 A * 8/1976 Krips
4,388,752 A * 6/1983 Vinciguerra et al.
4,581,817 A * 4/1986 Kelly
5,052,568 A * 10/1991 Simon ..... 220/634
5,179,780 A * 1/1993 Wintersteen et al.
5,293,765 A 3/1994 Nussbaum-Pogacnik
5,713,235 A 2/1998 Diekhoff et al.
5,718,352 A 2/1998 Diekhoff et al.
6,010,026 A * 1/2000 Diekhoff et al. ..... 220/228

FOREIGN PATENT DOCUMENTS

| | | | |
|---|---|---|---|
| CA | 720701 | * 12/1991 | ..... 220/228 |
| DE | 6903478 | 5/1969 | |
| DE | 29512058 | 12/1996 | |
| EP | 517676 | * 12/1991 | ..... 220/288 |
| EP | 0549987 | 7/1993 | |
| GB | 1445758 | 8/1976 | |
| GB | 1495668 | 8/1976 | |
| WO | 9806636 | 2/1998 | |

* cited by examiner

*Primary Examiner*—Gregory M. Vidovich
*Assistant Examiner*—Eric Compton
(74) *Attorney, Agent, or Firm*—Dennison, Schultz & Dougherty

(57) ABSTRACT

Process for manufacturing a metal can with a threaded neck on which a removable head can be fitted, includes the steps of forming a can with a closed bottom end, a cylindrical wall and an open top end, forming a neck at the open top end, obtaining a ring with a spindle hole of known diameter and a threaded external surface, sleeve fitting the ring by driving the spindle hole over the neck, and plastically expanding the neck by an amount sufficient that its outer diameter exceeds the diameter of the spindle hole when unstressed.

8 Claims, 3 Drawing Sheets

METHOD FOR MAKING AN AEROSOL HOUSING WITH THREADED NECK

TECHNICAL DOMAIN

This invention relates to a process for making cans made of a low carbon steel or aluminum alloy, manufactured by deep drawing, drawing and ironing or extrusion, in which the inner wall is covered with a protective coating and which are equipped with a threaded neck designed to fix any type of removable head, for example aerosol spray distribution heads, of the eco-refill type, but also for the attachment of a closing cap.

STATE OF ART

According to standard practice as described in GB 1 445 758, cans with a bottom and a cylindrical wall are manufactured starting from round and flat pieces made of low carbon steel or aluminum alloy, and using deep drawing, drawing and ironing of blanks or backward extrusion (impact extrusion) of slugs. Once formed, these cans are usually varnished on their inner surface, and painted and/or varnished on their outer surface. The open end of the can is then formed to have a cylindrical neck with a smaller diameter, and a strong plastic deformation is then applied by necking.

For practical reasons to facilitate application with a roller or a spray gun, it is better to apply the paint or varnish on the cylindrical surface before necking. The varnish on the inner surface is necessary for many types of applications, in order to prevent contact between the bare metal and the contents of the can. The metallic surface must be well protected throughout the period during which the can is being used and it is important that the inner varnish covers this surface fully and continuously. Prior art includes paints and varnish that remain undamaged during necking.

Since the metal used (low carbon steel or aluminum alloy) is an inexpensive and easy-to-recycle packaging material, it seemed a good idea to develop receptacles onto which aerosol spray distribution heads or covers could be screwed, as is the case for glass and plastic bottles. For example, the receptacle could then be sold full and a screwed cap could be fitted onto it. The user screws and unscrews the distribution head, designed for multiple use, according to his needs. The receptacle could then be refilled, or the consumer could throw it away with the rest of his waste, and it could be taken for recycling.

In order to obtain this type of metallic receptacle satisfying the "eco-refill" principle, it must be possible to make a thread, for example on the neck of the receptacle, in order to participate in the attachment of any type of head. This thread must not damage the varnish layer described above, that has been subjected to necking in order to form the neck, and which must maintain its protective properties in all cases.

In the past, the thread was usually made using internal tooling with a helical impression, acting mainly as a support and shaping mold, and an external tooling acting like one or several rollers. The European patent application EP 0 510 291 (NUSSBAUM) describes a process for making an improved thread, in which the thread(s) is(are) shaped by means of an internal tooling and an external tooling, both toolings being rotated in a coordinated manner such that sliding takes place between the neck material and each tooling. This prevents the neck metal from accumulating and folding in front of the external threading tool and being pushed in the direction of advance of the tooling.

The neck is then cut off on the same device, in other words without having removed the receptacle, leaving a bare surface, in other words unprotected and possibly with burrs, on the edge surrounding the orifice.

Problem that Arises

Even if sliding occurs between the tooling and the neck material, it is impossible to avoid further damage to the varnish. Thus, micro-crazing is observed on the varnish at the thread, both on the outer surface and the inner surface of the neck wall. This crazing makes the can more sensitive to corrosion by the packaged product.

Furthermore, with the can thus obtained, it is impossible to position the distributing head precisely with respect to the edge and the shoulder. It is difficult to control the position of the heads, which has negative consequences both on the leak tightness of the assembly and on its esthetic appearance.

Purpose of the Invention

The process according to the invention is a process for the manufacture of a metallic can comprising at least the following steps:

a) production of a can with a bottom and a cylindrical or shaped wall, for example by deep drawing, drawing and ironing, extrusion or extrusion-drawing, possibly followed by a painting or varnishing deposit on at least the inner surface of the cylindrical wall, followed by a varnish annealing treatment;

b) necking, in order to make a neck on the open end of the can, this step possibly being followed by cutting open end of the neck perpendicular to the center line of the can;

c) use of a ring with a spindle hole and threaded on its outer surface, and sleeve fitting of the said ring so that its spindle hole fits around the neck formed in the previous step, in an operation that will subsequently be called "sleeve fitting":

and characterized in that it also includes the following step:

d) plastic expansion of the said neck, the outside diameter of the neck being expanded until it is larger than the inside diameter of the spindle hole of the ring when unstressed.

The process is characterized by the use of a ring, for example made of a plastic molded ring (but it could be made of any other material—metallic, machined or die forged, etc.), with a globally toroidal shape, with a cylindrical inner surface that we will subsequently call the spindle hole, and an outer cylindrical threaded surface. The diameter of the spindle hole is slightly greater than the outside diameter of the neck that has just been formed on the can, such that the ring can be sleeve fitted into place freely.

The thread formed on the outer surface of the ring is preferably a standard thread, for example with a triangular or trapezoidal section, more suitable for precise positioning of the distributor head with respect to the metallic can. The thread obtained in prior art, in other words directly by rolling on the neck, was rounded and consequently imprecise. Furthermore, since rolling is no longer necessary to form the thread, there is no additional damage to the varnish on the inner surface of the neck of the can.

Finally, the choice of a plastic ring together with a distribution head fitted with an attachment skirt also made of plastic, improves the sealing conditions when the said distribution head is put into position by screwing.

A first end of the ring is brought into position facing the can neck that was obtained by necking during the previous step b) and the said neck is then inserted inside the spindle hole in the said ring. This is a relative movement; this sleeve fitting operation may also be made by moving the ring and keeping the can motionless. In this case, this step can be carried out in the same way as the previous and next steps, during the same can clamping phase, in other words these operations may be carried out on the same machine, the cans being placed on a circular rotating table for which the step by step rotation brings them in front of different tools in sequence, each adapted to one of these steps, and themselves installed on a circular tool holder plate. A device of this type has already been described, for example in FR 1 434 177 (LECHNER).

Since precise positioning of the heads to be fixed on the can is required, it is desirable to place the ring precisely on the neck and to create a stop system that gives good positioning at the end of sleeve fitting. The shape of the first end of the ring can be designed so that it is recessed and matches the shoulder of the can. It would also be possible, and preferable, to form a small shoulder on the neck, at a certain distance from the edge of the neck. This distance can be very precise when the shoulder is made at the same time as the end of the neck is cut off (optionally) in step b). The ring also has a surface that stops in contact with the shoulder formed on the neck. For example, this surface may be obtained by making a shoulder in the spindle hole. The shoulder made on the neck must be sufficiently "high" (radial height) so that it can act as a stop for the corresponding surface on the ring while it is being put into position, in other words before expansion of the neck.

The height of the neck above the spindle hole is controlled by this stop system acting when the ring is fully sleeve fitted. It is advantageous to include a subsequent step in which this part projecting beyond the ring is rolled outwards, so that it traps it and prevents any axial backwards movement. Therefore, the projection distance is chosen such that a rolled edge can be made, for example by stamping. It depends on the outside diameter of the plastic ring and the inside diameter of the neck.

Once the ring has been sleeve fitted and is in contact with the neck, the neck and the ring surrounding it are expanded, for example by stamping, the neck being expanded in the range of plastic deformations (in other words irreversible), the final diameter after elastic recovery being slightly greater than the diameter of the spindle hole of the ring at rest, in other words in the initial state free of any mechanical stress.

The neck is preferably expanded over its entire length, so as to obtain the largest possible contact surface between the neck and the ring after expansion.

By carrying out this type of deformation and ensuring that the elastic recovery effect of the spindle hole of the ring is greater than the elastic recovery effect of the neck, which is easy to ensure when the ring is made of a plastic material, a strong bond is obtained between the ring and the neck over the entire contact surface. The bond force between the ring and the neck depends on the amount of the expansion and the magnitude of their contact areas. The amount of the expansion is limited by the ductility of the neck material. The contact surface, which depends primarily on purely geometric conditions, is an easier parameter to control.

Expansion consists of applying a plastic deformation by expanding a metal that has already been strongly deformed during shaping of the cylindrical can (deformation which is particularly high close to the free edge of the can) and then strong necking. Consequently, the metal is in a very work hardened state, characterized by high mechanical properties but low residual ductility.

The applicant was surprised to observe that this residual ductility was actually greater than expected, due to the particular deformation history imposed on the metal; necking followed by circumferential expansion, the principal deformation axes remaining parallel to the axial, radial and ortho-radial directions at all times. However, although the metal is more ductile than expected, it is desirable to allow for a sufficiently large gap between the diameter of the ring hole and the initial diameter of the neck formed in step b) to facilitate sleeve fitting of the ring over the neck, but sufficiently small so that expansion will not cause necking, or even rupture of the metal.

The limiting value that must not be exceeded depends on the nature of the metal and the geometry of the can to be obtained, and can be determined experimentally using simulation tests reproducing the thermo-mechanical conditions of the various steps in the shaping process considered, on the metal considered. Preferably, expansion is carried out such that it results in an incremental plastic deformation exceeding 2% on the inner surface of the neck. The upper limit of this incremental plastic deformation varies as a function of the ductility of the alloy chosen, for which the work hardened state after necking is very favorable for good ductility in circumferential expansion.

In our example applicable to a particular geometry of a can made of a 1050 A alloy (inside diameter of the neck of the order of 15 mm), the clearance between the hole of the ring and the neck remains approximately one tenth of a millimeter, and the inside diameter of the neck after expansion is increased by about 0.3 mm, corresponding to an incremental plastic deformation of about 2% at the inner surface of the neck.

Therefore at the end of expansion, there is a strong bond over the entire contact surface between the neck and the hole of the ring. This bond can be quantified by measuring the untightening torque necessary to separate the ring from the neck, that we will subsequently call the sliding torque. In our example, it is found that the sliding torque exceeds 20 Nm, in other words that it is far greater than torques necessary to screw and unscrew the removable head. Standard NF H 35103 for glass rings can be used to estimate the order of magnitude of these tightening torques.

The process is advantageously followed by the following steps:

e) rolling, for example by stamping, the end of the neck f) smoothing, which consists of moving a roller bearing on the edge of the neck formed by rolling in the previous step, and designed to improve the surface condition of the varnish layer.

The edge is rolled preferably outwards, since in this case the ring can be fixed in position axially, preventing any axial backwards movement. However, the principal function of the rolled edge is to improve the leak tightness of the assembly, since it forms a rounded edge covered with varnish, in other words a toroidal shape with a circular section which is much more suitable to produce a leak tight joint than the as-cut edge, bare and flat edge, on which burrs may be present, used in prior art. Furthermore, this geometry prevents contact between the packaged product and the metal edge that is not necessarily protected by varnish.

There is no doubt that the varnished layer is damaged once again during rolling, resulting in a disturbed surface condition on which there are sharp edges and micro-cracks, fairly similar to what is observed on threads obtained by rolling directly. The next smoothing operation is designed to improve this surface condition, by closing crazing and leveling of sharp edges.

These two additional operations can thus give particularly satisfactory leak tightness of the can+head assembly.

If the ring is made of plastic, it is recommended that the stress relaxation that inevitably takes place in this type of material should be taken into account, and which has the consequence of reducing the tightness a few hours after expansion. Taking account of geometric manufacturing tolerances, this loosening may be significant, in other words sufficient so that the ring can no longer resist the head screw untightening torque, which would trap it on the can without providing leak tightness. In this situation, the can would then be unsuitable for use.

Longitudinal grooves can be made in the hole of the plastic ring in order to prevent the unwanted effects of this loosening. The applicant has observed that this type of relief on the surface of the hole, which is easy to produce while the ring is being molded, improves the long term tightness between the ring and the neck, no doubt because it modifies the distribution and intensity of stresses and therefore the effect of stress relaxation.

Additional operations can also be carried out on the neck before sleeve fitting the ring; for example sanding, scratching, deformation by rolling, machining, allowing at least one pin to project during machining of the shoulder that acts as a ring penetration stop. An inverse thread can also be made on the neck and on the ring, to be sure that it is always possible to unscrew the head even if the ring is completely loose.

Thus, it is possible to make a receptacle according to the invention with a metal can fitted with the neck, designed to be fixed to any type of removable head (of the eco-refill type), the head being fitted with fastening means such as a thread, a rim or a click fit groove, characterized in that it comprises a ring fitted with additional fastening means other than those on the head, the said ring bonding to the neck of the metallic can with a sufficiently strong bond to resist the removable head separation torque.

The distribution head is usually covered by a protective cap that is fitted with a cylindrical skirt that extends close to the shoulder of the can. For the purposes of this invention, this inner end of the skirt and the lower end of the ring can be fitted with means of preventing the receptacle from being opened, for example a radial click fit locking system (vertical attachment), or notches inside a breakable locking strip (plastic rings with unbreakable notches and multi-notches).

Due to the presence of the ring used in this invention, it is possible to have eco-refill type metal cans equipped with tamperproof locking systems. The rolling means used in prior art resulted in a rounded and imprecise thread, but could not be used to make a sufficiently sharp relief capable of trapping a locking strip. However, with the ring according to this invention, this sharp relief is easy to form during molding, for example by increasing the outside diameter at the first end of the ring.

This end thus acts as a mating ring, the edge of which can trap a tamperproof strip, for example connected to the inner end of a cap skirt by several breakable bridges, like the ring described in EP 0 107 680. This ring can also be fitted with ratchet teeth, and the tamperproof means described in FR 2 665 142 can be reproduced. This latter system has the advantage that a large torque is not necessary to separate the strip.

The process according to the invention will be better understood after reading the detailed description of a particular embodiment, presented as a non-limitative example.

EXAMPLE EMBODIMENT OF THE INVENTION

Figure 1:
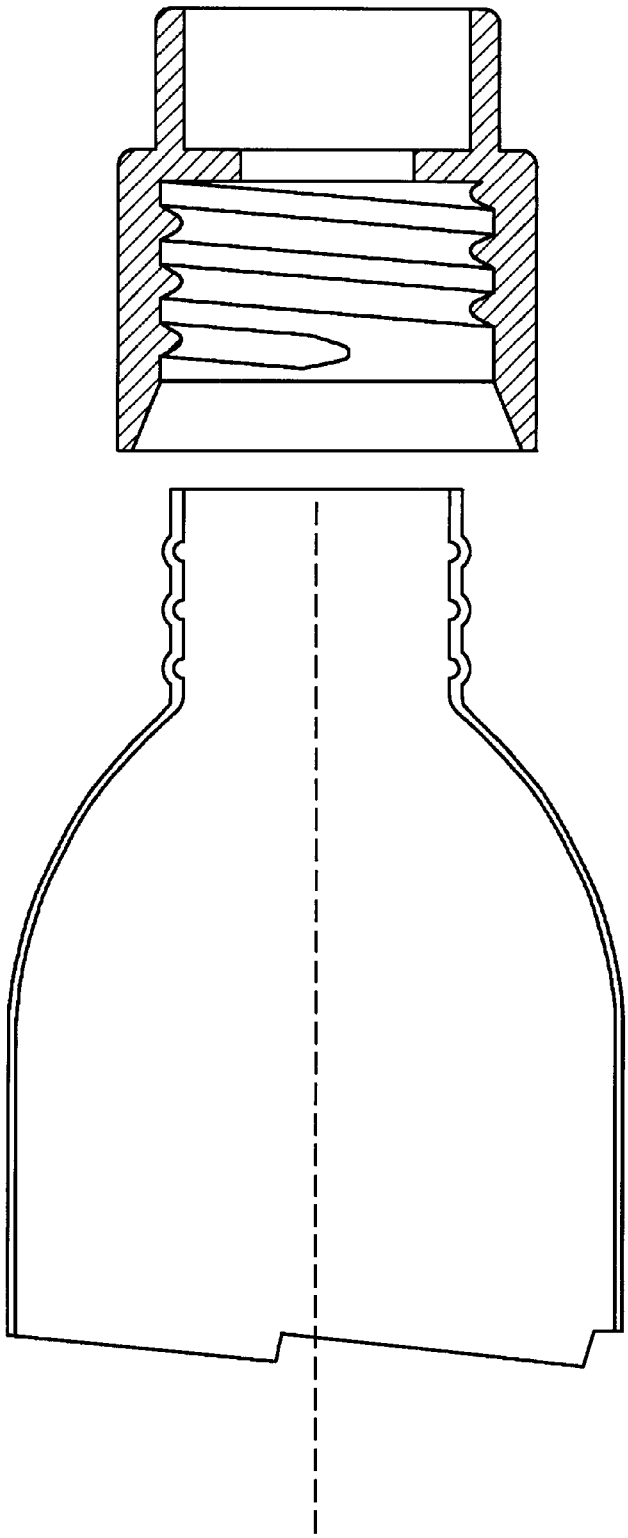
FIG. 1 PRIOR ART
FIG. 1 shows a can with a threaded neck according to prior art associated with the bottom part of a distribution head provided with a hole in which a pump can be fitted in order to distribute the product in the spray form.
Figure 2:
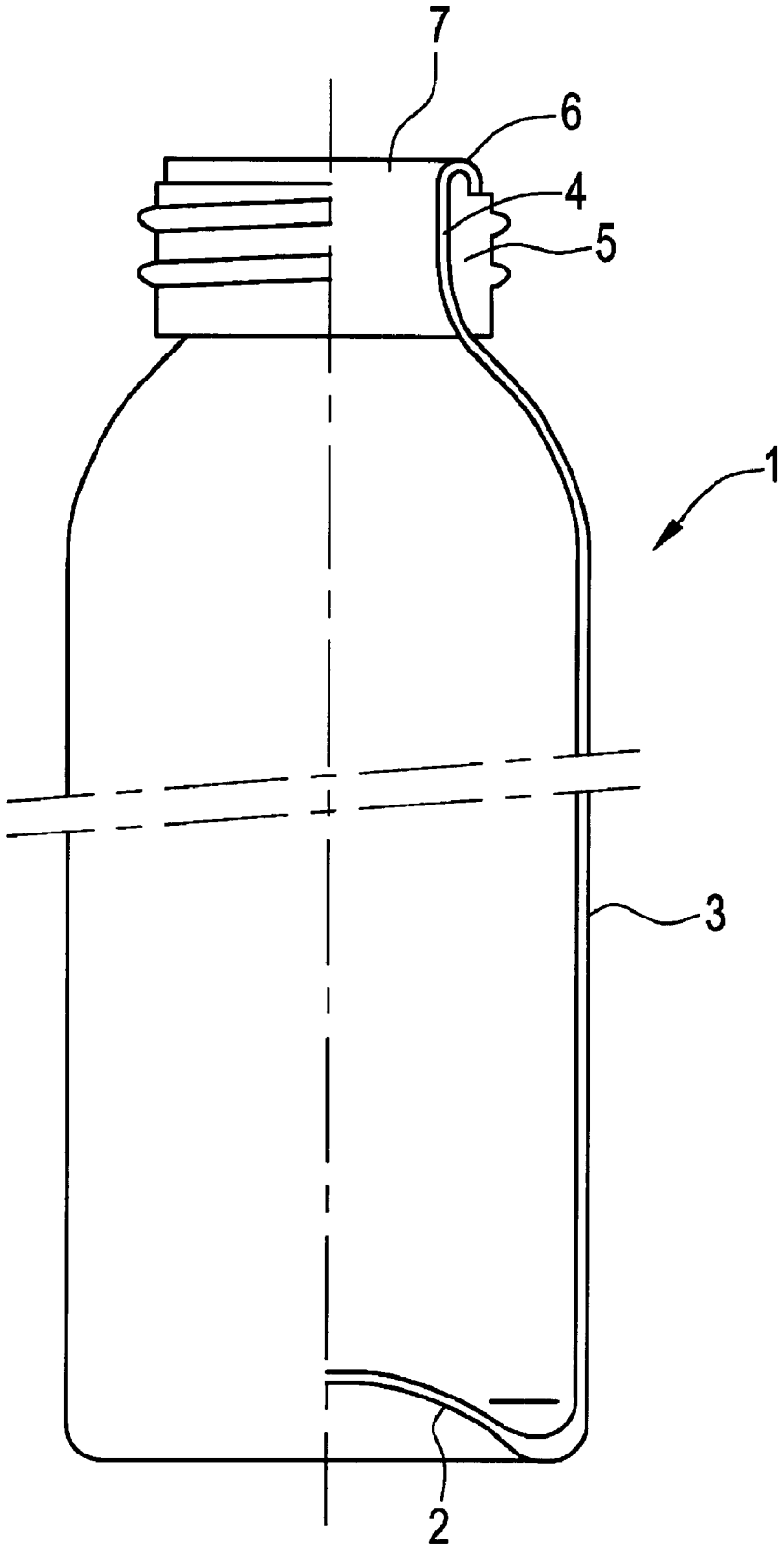
FIG. 2 shows a can with a threaded neck designed for the attachment of an aerosol distributor made according to the invention.

The can 1 illustrated in FIG. 2 is made of a 1050A aluminum alloy. It is composed of a bottom 2 and a cylindrical wall 3 with diameter 35 mm. Its free end has been formed into an approximately cylindrical neck 4 with height and diameter equal to approximately 10 mm and 15 mm respectively. The ring 5 is made of polypropylene. It is held fixed onto neck 4 by expansion of the neck made according to the invention and by rolling the end 48 of the neck 4 leading to the formation of a rounded edge 6, in other words with a circular toroidal shape, and always coated with varnish. The edge 6 forms the edge (rounded in this the open end of the can surrounding its orifice 7.

Figure 3:
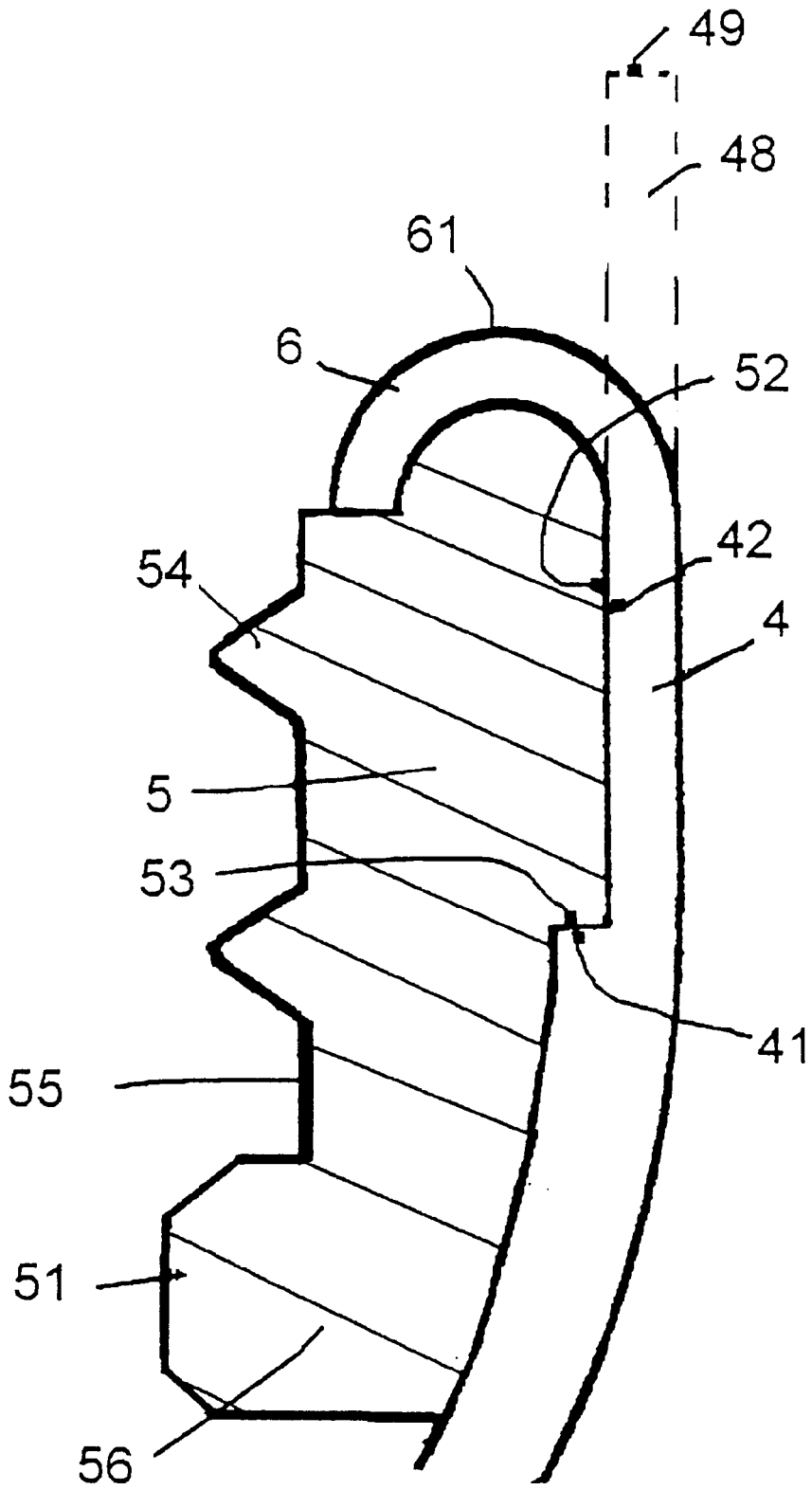
FIG. 3 shows a diametric half-section of an enlarged view of the neck and the ring obtained by the process according to the invention, after the ring has been sleeve fitted, the neck has been expanded and the free edge of the neck has been rolled. This same figure shows the free end of the neck before rolling, in dashed lines.

The ring 5, more easily seen on the half-section in FIG. 3, is of molded polypropylene. Its shape is globally toroidal, with a spindle hole 52 and an external cylindrical surface 55 on which a thread 54 is formed. The diameter of the spindle hole 52 is slightly greater than the outside diameter of the neck of the can obtained by necking (average 0.1 mm, maximum 0.3 mm), such that the ring may be sleeve fitted without applying force. The thread 54 formed on the outer surface 55 of the ring 5 is a standard thread with a triangular section. The ring also has a shoulder 53 formed in the spindle hole 52, the small ledge being designed to form a stop on the shoulder 41 formed on the neck 4 of the can after the ring 5 has been fully sleeve fitted on neck 4.

The process for making the can in this example comprises the conventional steps for making an aluminum allow aerosol can:

- slugs made of 1050 A aluminum alloy
- tumbling of slugs in the presence of a lubricant such as zinc stearate
- impact extrusion of the slugs, possibly followed by one or several drawing passes
- trimming of the end
- stripping, designed to eliminate traces of extrusion and drawing lubricants
- deposition of varnish by spraying on the inner surface, followed by baking at about. 200–265° C. designed to dry and polymerize the said varnish
- deposition of a coat of lacquer with a roller, followed by drying
- the can decor is printed, usually by offset, and possibly followed by an overprinting varnish and baking again
- the cans are put into position on a circular table rotating step by step, bringing each can in front of a different tool in each step, the tools being adapted to the different phases described below, these tools themselves being mounted on a circular tool holder plate.
  - formation of the neck and cutting of the free edge.
    - Necking is done gradually by stamping in several passes with shaping dies, the final die matching the required shape of the shoulder.
    - While cutting the free edge 49 of the neck 4, a small shoulder 41 is formed on the neck at a precise distance from the top end 49 of the neck 4.

sleeve fitting the ring

A first end 51 of the ring 5 is put into position facing neck 4 of can 1 which was obtained by necking during the previous step, and ring 5 is then sleeve fitted on neck 4.

When the shoulder 53 formed in the spindle hole 52 of the ring 5 stops in contact with the shoulder 41 on neck 4, the ring 5 is retained in this position.

This stop system acting after the ring has been sleeve fitted, controls the height of the part 48 of neck 4 that projects from the spindle hole 52. In this case it is of the order of 2 mm.

The first end 51 of the ring is molded such that it acts as a mating ring 56 on which a locking strip can be fixed.

Expansion

Once the ring has been sleeve fitted and held in contact with the ring, the neck 4 and the ring 5 are expanded by stamping until the diameter of the outer surface 42 of the neck 4 is greater than the diameter of the spindle hole 52 of the ring 5 at rest, after elastic recovery.

In this case expansion is done by stamping, in other words using an internal tool that is inserted in the orifice and then applying pressure to the free edge. The conical and then cylindrical shape of the stamping tool imposes a plastic expansion that increases the diameter of the outer surface 42 of the neck 4 by about 0.5 mm, over the entire length L of the cylindrical part of the neck. This thus gives a strong bond over the entire contact surface between the neck and the hole of the ring. The spindle hole of the ring is marked with longitudinal striations, which eliminates any risk of loosening due to stress relaxation that occurs sometimes after expansion.

rolling and smoothing

The end 48 of the neck 4 projecting from the ring is then rolled by stamping. The rounded edge 6 thus formed fixes the ring in position axially, and in particular forms a rounded edge, always covered with varnish, improving the tightness of screwed can+head assemblies.

The next smoothing operation, designed to improve the surface condition of the varnish at the rounded rolled edge, consists of passing the roller over the said rolled edge with a very low pressure, just sufficient to smooth off rough edges created on the varnish and to close off cavities created during the previous steps.

With this geometry (inside diameter of the neck of the order of 15 mm), the ring according to the invention is rigidly fixed on the bottle neck since it resists a sliding torque exceeding 20 Nm. This value can then be compared with the range of values of unscrewing torques to be applied to cap rings (between 2 and 8 Nm), particularly in standard AFNOR NF H 35103 (glass rings and caps).

Advantages of the process according to the invention

This process can be used to make eco-refill type cans.

The interchangeable head can easily be detached from the can, so that each part used in the assembly can easily be recovered and recycled.

The varnish is less damaged on the inner surface of the neck, which makes the can less sensitive to corrosion by the product contained in it.

The ring is positioned such that the distributor head is fixed in leaktight manner and is in a precise and repeatable position with a controlled clearance between the skirt and the shoulder, favorable to improving the esthetic appearance of the assembly.

For the first time, an eco-refill type metallic can can be fitted with a distribution head protected by a tamperproof strip.

What is claimed is:

1. Process for manufacturing a metal can with a threaded neck on which a removable head can be fitted, comprising the steps of:

forming a can with a closed bottom end, a cylindrical wall and an open top end;

forming a neck having an outer surface at the open top end;

obtaining a ring with an inner surface defining a spindle hole of known diameter and a threaded external surface, and sleeve fitting the ring by driving the spindle hole over the neck; and plastically expanding the neck by an amount sufficient that its outer diameter exceeds the diameter of the spindle hole when unstressed, and causing thereby mating of the outer surface of the neck with the inner surface of the ring, the ring being made of a material sufficiently resilient that its spring back effect after said expanding is greater than spring back effect of the neck, wherein the mating surfaces of the neck and the ring have a substantially constant diameter within any transverse plane therehrough.

2. Process according to claim 1, wherein said plastic expansion corresponds to an incremental plastic deformation of at least 2% of the neck at its inner surface.

3. Process according to claim 1, wherein the neck comprises a shoulder which acts as a stop during the sleeve fitting.

4. Process according to claim 1, wherein the ring is a plastic ring.

5. Process according to claim 1, wherein the neck has a height sufficient that a portion of the neck projects beyond the ring after the sleeve fitting, additionally comprising the step of rolling the projecting portion of the neck to form a rolled edge.

6. Process according to claim 5, additionally comprising the step of smoothing the rolled edge.

7. Receptacle comprising a metal can having a neck having an outer surface adapted to be secured to a removable head, the receptacle further comprising a ring having an inner surface defining a spindle hole with an inner diameter disposed around the neck and having a securing means for the removable head on its outer surface, the ring being bonded to the metal can by expansion of the neck by an amount sufficient that its outer diameter is greater than the inner diameter of the ring in an unstressed state and causing thereby mating of the outer surface of the neck with the inner surface of the ring, to result in a bond of sufficient strength to resist separation torque from the removable head, the ring being made of a material sufficiently resilient that its spring back effect after expansion is greater than spring back effect of the neck, wherein the mating surfaces of the neck and the ring have a substantially constant diameter within any transverse plane therethrough.

8. Receptacle according to claim 7, wherein the securing means comprises threads, and the ring additionally comprises tamperproof means.

* * * * *